US008290194B2

(12) United States Patent
Kuo

(10) Patent No.: US 8,290,194 B2
(45) Date of Patent: Oct. 16, 2012

(54) WIRELESS HEADPHONE INTEGRATED WITH AN ADJUSTMENT CONTROL DEVICE

(75) Inventor: Kuan I Kuo, Taipei County (TW)

(73) Assignee: Encounters Products Corp., Taipei (TW)

( * ) Notice: Subject to any disclaimer, the term of this patent is extended or adjusted under 35 U.S.C. 154(b) by 702 days.

(21) Appl. No.: 12/511,331

(22) Filed: Jul. 29, 2009

(65) Prior Publication Data

US 2011/0026726 A1 Feb. 3, 2011

(51) Int. Cl.
*H04R 25/00* (2006.01)

(52) U.S. Cl. ..... 381/375; 381/374; 381/370

(58) Field of Classification Search ..... 381/375
See application file for complete search history.

(56) References Cited

U.S. PATENT DOCUMENTS 2,428,746 A * 10/1947 Veneklasen ..... 379/430
3,999,020 A * 12/1976 Bastiaans et al. ..... 381/372
4,297,535 A * 10/1981 Hehemann ..... 381/382
4,802,243 A * 2/1989 Griffiths ..... 2/422
5,793,878 A * 8/1998 Chang ..... 381/370
7,391,863 B2 * 6/2008 Viduya et al. ..... 379/430
7,885,419 B2 * 2/2011 Wahl et al. ..... 381/74

* cited by examiner

*Primary Examiner* — Curtis Kuntz
*Assistant Examiner* — Thomas Maung
(74) *Attorney, Agent, or Firm* — WPAT, P.C.; Anthony King

(57) ABSTRACT

A wireless headphone integrated with an adjustment control device includes a headphone, a tuning unit having a base disposed on a side of the headphone containing an ear muff, a rotatable tuning shaft protruded from the base and coupled to a knob, a direction changing unit having a through hole at the middle of the direction changing unit and rotably coupled to the base, such that the tuning shaft is passed through the through hole, a microphone unit movably coupled to the direction changing unit, such that the microphone unit can be rotated, extended, contracted or adjusted by the direction changing unit. Therefore, the wireless headphone integrated with an adjustment control device achieves the effects of simplifying the assembly structure, lowering the manufacturing cost, and beautifying the appearance of the headphone.

6 Claims, 3 Drawing Sheets

A-A'

WIRELESS HEADPHONE INTEGRATED WITH AN ADJUSTMENT CONTROL DEVICE

FIELD OF THE INVENTION

The present invention relates to a wireless headphone integrated with an adjustment control device, in particular to an improved wireless headphone structure integrated with a microphone adjusting structure and a volume control structure.

BACKGROUND OF THE INVENTION

In a conventional wireless headphone or cable earphone having a microphone, a volume control knob is generally coupled to an ear muff on a side of the headphone or earphone, and the microphone is installed at a predetermined position, such that the microphone can be adjusted to an appropriate position according to a user's using habit. In general, a link rod is used for connecting the ear muff and the microphone, such that when an end of the link rod is coupled to a connecting portion of the link rod of the ear muff, it is necessary to use another fixing element such as a screw, a nut, and the like to make the connecting portion of the link rod as a rotatable and contractible structure. In the foregoing conventional design of installing the volume control knob on the ear muff and the connecting portion of the link rod separately, the number of components is increased significantly, the assembled structure is complicated, the cost is high, and the aesthetic appearance of the headphone is affected adversely.

SUMMARY OF THE INVENTION

In view of the aforementioned shortcomings of the conventional wireless headphone or cable earphone having a microphone, the inventor of the present invention based on years of experience in the related industry to conduct extensive researches and experiments, and finally developed a wireless headphone integrated with an adjustment control device in accordance with the present invention to achieve the effects of simplifying the assembled structure, lowering the manufacturing cost, and beautifying the appearance of the headphone.

Therefore, it is a primary objective of the present invention to provide a wireless headphone integrated with an adjustment control device, comprising a tuning unit integrated with an ear muff on a side of the headphone, a direction changing unit, and a microphone unit, such that the improved design of the wireless headphone can reduce the number of components and achieve the effects of simplifying the assembled structure, lowering the manufacturing cost, and beautifying the appearance of the headphone.

A secondary objective of the present invention is to provide a wireless headphone integrated with an adjustment control device, including a structural design of a direction changing unit, such that the microphone unit can be turned, extended, contracted and adjusted freely to an appropriate position to fit a user's using habit.

DESCRIPTION OF THE PREFERRED EMBODIMENTS

Other features and advantages of the present invention will become apparent in the following detailed description of the preferred embodiments with reference to the accompanying drawings.

Figure 1:
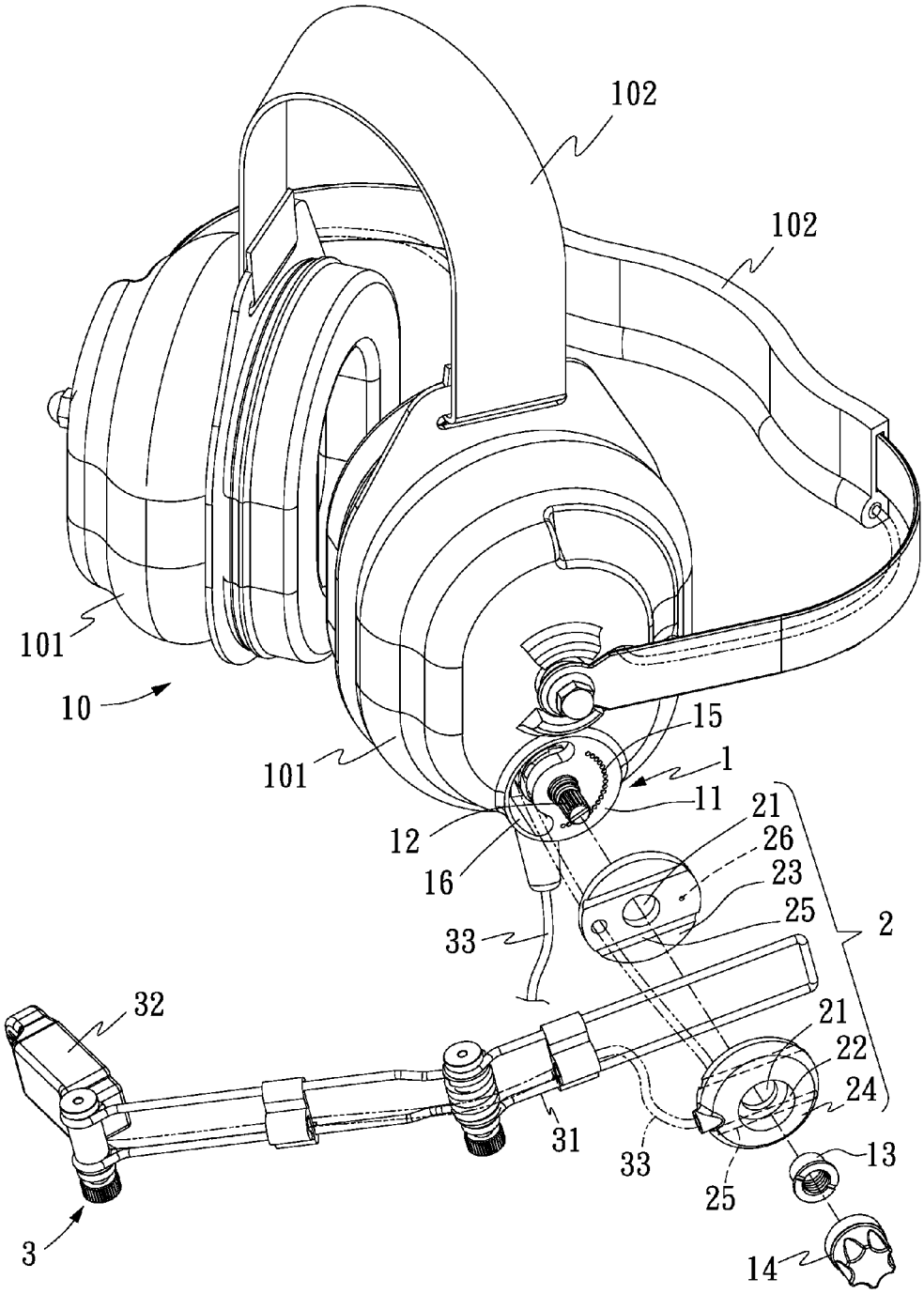
FIG. 1 is an exploded view of a preferred embodiment of the present invention.
Figure 2:
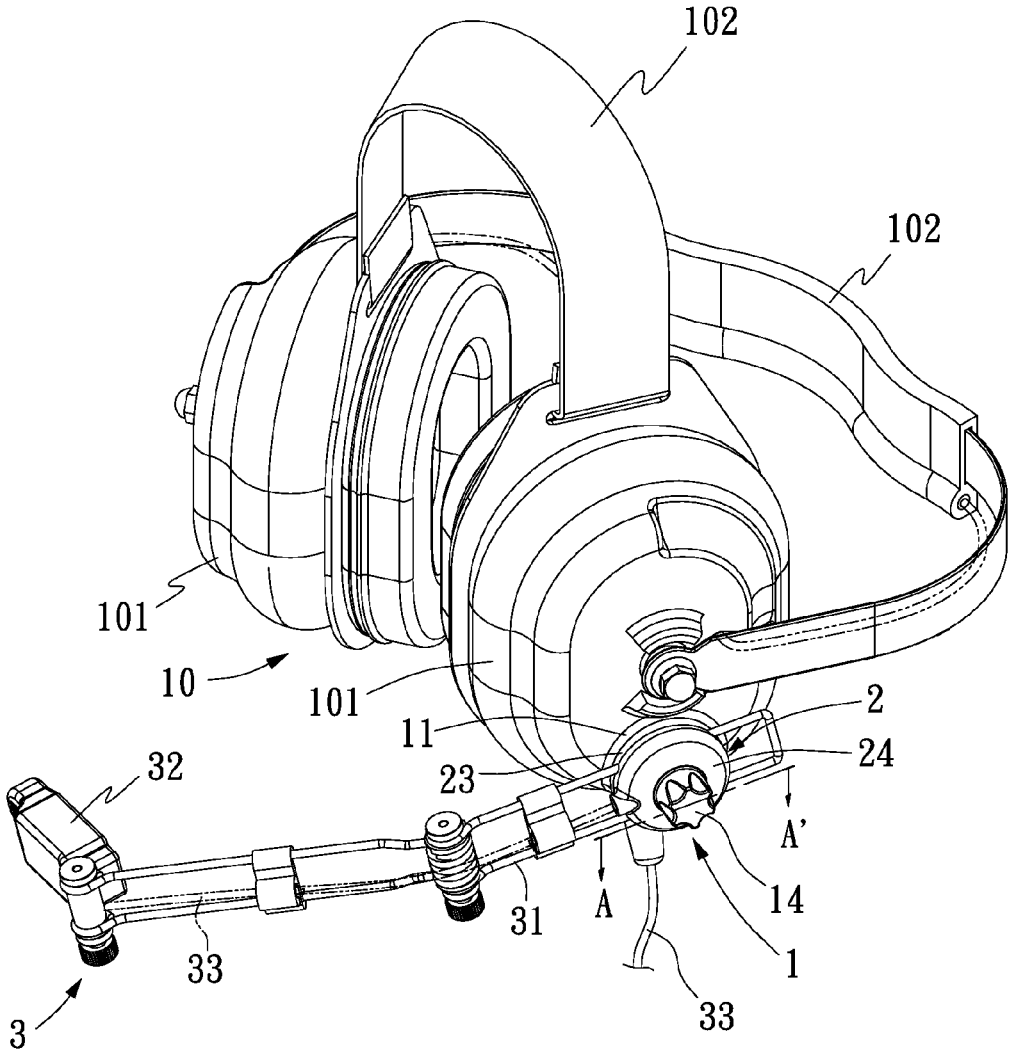
FIG. 2 is a perspective view of a preferred embodiment of the present invention.
Figure 3:
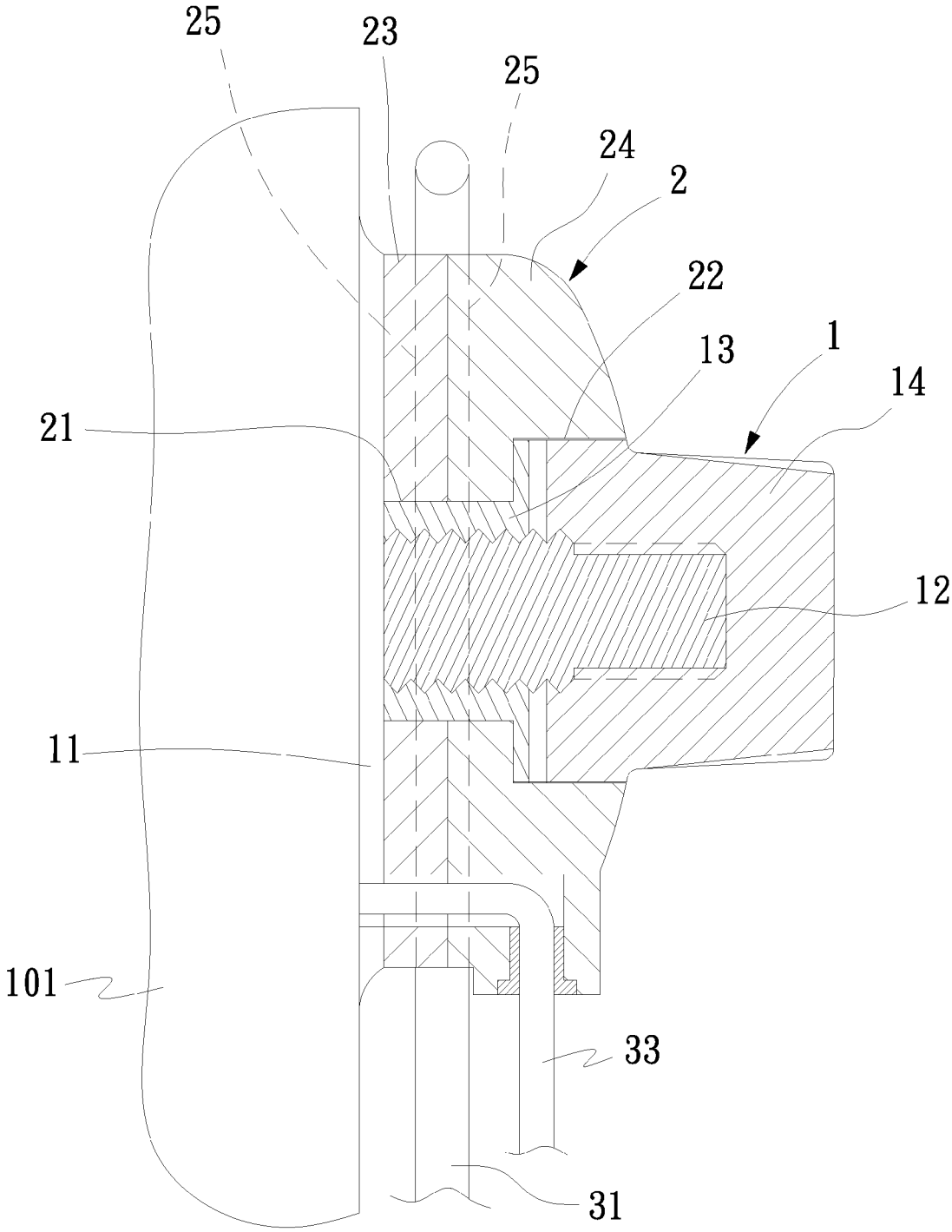
FIG. 3 is a cross-sectional view of a preferred embodiment of the present invention.

With reference to FIGS. 1 to 3 for a wireless headphone integrated with an adjustment control device in accordance with a preferred embodiment of the present invention, the wireless headphone comprises a tuning unit 1 integrated with an ear muff 101 which is installed on a side of the headphone 10, a direction changing unit 2 and a microphone unit 3.

The headphone 10 as shown in FIG. 1 includes two ear muffs 101, and one or more semicircular head bands 102 connected between the two ear muffs 101, and each ear muff 101 includes a speaker and other necessary electronic components, and one of the ear muffs 101 has a signal line 33 connected to a wireless transmitter.

The tuning unit 1 as shown in FIGS. 1 and 3 includes a circular base 11 protruded from a side of one of the ear muffs 101 of the headphone 10, a rotatable tuning shaft 12 protruded from the center of the base 11 and coupled to a fixing element 13 and a knob 14 sequentially, and a nut for connecting the fixing element 13 and the tuning shaft 12, and the fixing element 13 is provided for fixing the direction changing unit 2 onto the base 11.

The direction changing unit 2 as shown in FIGS. 1 to 3 includes a through hole 21 disposed at a middle section of the direction changing unit 2, and a containing hole 22 disposed at an external end of the through hole 21 and having a larger diameter than the through hole 21, such that the tuning shaft 12 can be passed through the through hole 21 and the containing hole 22. The aforementioned fixing element 13 and knob 14 are connected to the tuning shaft 12 at the containing hole 22 and rotably coupled onto the base 11 of the tuning unit 1. The direction changing unit 2 of a preferred embodiment is comprised of a first rotating element 23 and a second rotating element 24 abutted against one another, and the first rotating element 23 and the second rotating element 24 have the through holes 21 disposed at middle sections of the first rotating element 23 and the second rotating element 24 respectively, and the containing hole 22 is disposed at an external end of the through hole 21 of the second rotating element 24, and one or more slide slots 25 are disposed on internal abutted surfaces of the first rotating element 23 and the second rotating element 24, such that the slide slot 25 can be used for mounting a microphone unit 3, and the fixing element 13 and the knob 14 are coupled to the tuning shaft 12 at the containing hole 22 to abut the first rotating element 23 and the second rotating element 24 against one another.

The microphone unit 3 as shown in FIG. 1 includes a group of bendable link rods 31, a microphone 32 connected to a front end of the link rod 31, and a signal line 33 connected to the microphone 32. The link rod 31 can be composed of one or more metal bars, such that a rear end of the link rod 31 can be slidably clamped into the slide slot 25 of the direction changing unit 2, and the rotatable structure of the direction changing unit 2 can be used as a structure for moving the link rod 31 in the slide slot 25 to achieve the functions of turning, extending, contracting and adjusting the microphone unit 3 freely.

To fix a rotated and adjusted microphone unit 3 as shown in FIG. 1 into a specific angle, the present invention can come with a plurality of concave holes 15 arranged in a semicircular shape on the base 11 of the tuning unit 1, and at least one protrusion 26 disposed at a corresponding position of the direction changing unit 2, such that the protrusion 26 can be embedded into the concave hole 15 to achieve the effect of fixing the rotated and adjusted microphone unit 3 into a specific angle. In FIG. 1, an arc hole 16 is disposed at the base 11 of the tuning unit 1, and the signal line 33 of the microphone unit 3 is passed through the direction changing unit 2 and the arc hole 16, such that the signal line 33 can be connected to a wireless transmitter.

With the design of the wireless headphone integrated with an adjustment control device of the present invention, the base 11 and the tuning shaft 12 are installed on one of the ear muffs 101 of the headphone 10 of the tuning unit 1, and the direction changing unit 2 is rotably coupled onto the base 11 of the tuning unit 1, and the fixing element 13 and the knob 14 are used as structures for connecting the tuning shaft 12. In the meantime, the direction changing unit 2 is fixed, such that the microphone unit 3 can be connected to the direction changing unit 2 to achieve the freely rotating, extending, contracting and adjusting effects. The assembled structure of the tuning unit 1 integrated with the direction changing unit 2 can achieve the effects of reducing the number of fixing elements, simplifying the structure of the ear muff 101 to provide a simple assembled structure, lowering the manufacturing cost and beautifying the appearance of the headphone.

What is claimed is:

1. A wireless headphone integrated with an adjustment control device, comprising:

a headphone;

a tuning unit, including a base disposed on a side of the headphone containing an ear muff, and a tuning shaft disposed at the base and coupled to a fixing element and a knob sequentially;

a direction changing unit, having a through hole, and turnably coupled to the base of the tuning unit, and the tuning shaft of the tuning unit passing through the through hole and connecting with the fixing element and the knob; and a microphone unit, including a bendable link rod, a microphone connected to a front end of the link rod, and a signal line connected to the microphone, and a rear end of the link rod being slidably coupled to the direction changing unit;

wherein the base of the tuning unit includes a plurality of concave holes arranged in a semicircular shape, and the direction changing unit includes at least one protrusion disposed at a corresponding position and embedded into the concave hole;

wherein the base of the tuning unit has an arc hole arranged in a semicircular shape, and the signal line of the microphone unit is passed through the direction changing unit and the arc hole and connected to a wireless transmitter.

2. The wireless headphone integrated with an adjustment control device as recited in claim 1, wherein the direction changing unit includes a containing hole disposed at an external end of the through hole and having a larger diameter than that of the through hole, and the tuning shaft is passed through the through hole and the containing hole, and the fixing element and the knob are coupled to the tuning shaft in the containing hole, such that the direction changing unit can be rotably coupled onto the base of the tuning unit.

3. The wireless headphone integrated with an adjustment control device as recited in claim 2, wherein the direction changing unit includes a first rotating element and a second rotating element abutted against one another, and the through hole is disposed separately at middle sections of the first rotating element and the second rotating element, and the containing hole is disposed at an external end of the through hole of the second rotating element.

4. The wireless headphone integrated with an adjustment control device as recited in claim 1, wherein the direction changing unit includes a first rotating element and a second rotating element abutted against one another, and the through hole is disposed separately at middle sections of the first rotating element and the second rotating element, and one or more slide slots are disposed separately on an internal abutted surface of the first rotating element and second rotating element, and fixed to the link rod of the microphone unit.

5. The wireless headphone integrated with an adjustment control device as recited in claim 4, wherein the link rod is comprised of one or more metal bars, and a rear end of the link rod is clamped into the slide slot of the direction changing unit.

6. The wireless headphone integrated with an adjustment control device as recited in claim 1, wherein the headphone comprises two ear muffs and a head band connected between the two ear muffs, and one of the ear muffs includes a signal line connected to a wireless transmitter.

* * * * *